US006872063B2

(12) United States Patent
Kimura et al.

(10) Patent No.: US 6,872,063 B2
(45) Date of Patent: Mar. 29, 2005

(54) SCROLL TYPE COMPRESSOR HAVING AN ELASTIC MEMBER URGING THE MOVABLE SCROLL MEMBER TOWARD THE FIXED SCROLL MEMBER

(75) Inventors: Kazuya Kimura, Kariya (JP); Hiroyuki Gennami, Kariya (JP); Kazuhiro Kuroki, Kariya (JP); Ken Suitou, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/692,366

(22) Filed: Oct. 23, 2003

(65) Prior Publication Data

US 2004/0136855 A1 Jul. 15, 2004

(30) Foreign Application Priority Data

Oct. 25, 2002 (JP) ..... 2002-311374

(51) Int. Cl.[7] ..... F04C 18/04
(52) U.S. Cl. ..... 418/55.5
(58) Field of Search ..... 418/55.5, 57

(56) References Cited

U.S. PATENT DOCUMENTS

| | | | | |
|---|---|---|---|---|
| 3,884,599 A | * | 5/1975 | Young et al. | 418/55.5 |
| 5,588,820 A | | 12/1996 | Hill et al. | 418/55.4 |
| 6,224,059 B1 | | 5/2001 | Sun | 277/364 |
| 2002/0039540 A1 | | 4/2002 | Kuroki et al. | 418/55.5 |

FOREIGN PATENT DOCUMENTS

| | | | | |
|---|---|---|---|---|
| EP | 1 055 824 | | 11/2000 | |
| EP | 2000345979 | | 12/2000 | |
| JP | 59-058188 | | 4/1984 | |
| JP | 4-36083 | * | 2/1992 | 418/55.5 |
| JP | 4-94483 | * | 3/1992 | 418/55.5 |
| JP | 4-166690 | * | 6/1992 | 418/55.5 |
| JP | 6-241177 | * | 8/1994 | 418/55.5 |
| JP | 09-310687 | | 12/1997 | |
| JP | 2000-249086 | | 9/2000 | |

OTHER PUBLICATIONS

EP 03 02 4453 Search Report dated Apr. 15, 2004.

* cited by examiner

*Primary Examiner*—John J. Vrablik
(74) *Attorney, Agent, or Firm*—Woodcock Washburn LLP

(57) ABSTRACT

A scroll type compressor includes a housing, a fixed scroll member and a movable scroll member. An elastic member is formed in an annular and planar shape and is fixed in the housing on a side of a back surface of the movable base plate so as to slidably contact the back surface of the movable base plate of the movable scroll member at a sliding region of the elastic member. A facing wall is provided on a side opposite to a side of the movable scroll member with respect to the elastic member. A first space is formed between the elastic member and the facing wall for allowing the elastic member to be elastically deformed. The elastic member is elastically deformed toward the facing wall by pressure-contacting the movable scroll member, whereby the movable scroll member is urged toward the fixed scroll member.

13 Claims, 4 Drawing Sheets

SCROLL TYPE COMPRESSOR HAVING AN ELASTIC MEMBER URGING THE MOVABLE SCROLL MEMBER TOWARD THE FIXED SCROLL MEMBER

BACKGROUND OF THE INVENTION

The present invention relates to a scroll type compressor for use in an air-conditioning system for a vehicle.

Conventionally, a scroll type compressor includes a housing, a fixed scroll member and a movable scroll member. The fixed scroll member is fixed in the hosing and has a fixed bass plate and a fixed spiral wall. The movable scroll member has a movable base plate and a movable spiral wall that is engaged with the fixed spiral wall of the fixed scroll member. A compression chamber defined between the fixed and movable spiral walls is gradually reduced in volume as refrigerant gas in the compression chamber is gradually compressed and is moved toward a center side of the spiral walls by orbital movement of the movable scroll member. Therefore, the refrigerant gas is compressed.

There is a scroll type compressor in which a ring is interposed between the housing and the movable base plate of the movable scroll member to urge the movable scroll member towards the fixed scroll member, in order to enhance the sealing of the compression chamber against compression reactive force applied to the movable scroll member in an axial direction of a rotary shaft of the compressor (e.g. column [0036] and FIG. 8 in Japanese Unexamined Patent Publication No. 8-219063).

Namely, a receiving wall is formed in the housing so as to receive the compression reactive force from a back surface of the movable base plate of the movable scroll member in the axial direction of the rotary shaft. The ring is interposed between the receiving wall and the movable base plate of the movable scroll member. A part of an annular and planar body of the ring is bent, thereby the shape of the cross section around the bent portion of the ring is formed so as to function as a spring. The spring-shaped portion of the ring is elastically interposed between the receiving wall and the movable base plate of the movable scroll member.

Therefore, dimensional tolerances of the movable and fixed scroll members in the axial direction of the rotary shaft are absorbed by elastic deformation of the spring-shaped portion of the ring. It is unnecessary to adjust the cam between the fixed and movable scroll members in the axial direction of the rotary shaft when the scroll type compressor is assembled.

However, it takes labor hour to change the shape of the cross-section of the ring so as to function as a spring. Also, even if the shape of the spring-shaped portion of the ring is slightly different from a desired shape, the force to urge the movable scroll member is varied relatively. Therefore, in order to cope with the securement of the sealing of the compression chamber and the suppression of the sliding resists between the fixed and movable scroll members, it is necessary to manufacture the spring-shaped portion with a high degree of accuracy. These things cause high cost of the scroll type compressor.

SUMMARY OF THE INVENTION

The present invention provides a scroll type compressor whose elastic member can be manufactured at a relatively low cost.

In accordance with the present invention, a scroll type compressor includes a housing. A fixed scroll member is fixed in the housing and has a fixed base plate and a fixed spiral wall that extends from the fixed base plate. A movable scroll member is placed in the housing and has a movable base plate and a movable spiral wall that extends from the movable base plate. The movable spiral wall is engaged with the fixed spiral wall. A compression chamber is defined between he movable spiral wall and the fixed spiral wall. The compression chamber is gradually reduced in volume as refrigerant in the compression chamber 18 gradually compressed and is moved toward a center side of the spiral walls by orbital movement of the movable scroll member relative to the fixed scroll member. An elastic member is formed in an annular and planar shape and is fixed on a side of a back surface of the movable base plate in the housing so as to slidably contact the back surface of the movable base plate at a sliding region of the elastic member. A facing wall is provided on a side opposite to a side of the movable scroll member with respect to the elastic member. A first space is formed between the elastic member and the facing wall for allowing the elastic member to be elastically deformed. The elastic member is elastically deformed toward the facing wall by press-contacting of the movable scroll member, whereby the movable scroll member is urged toward the fixed scroll member.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENT

A preferred embodiment according to the present invention will be described. The present invention is applied to a scroll type compressor for use in an air-conditioner for a vehicle.

Figure 1:
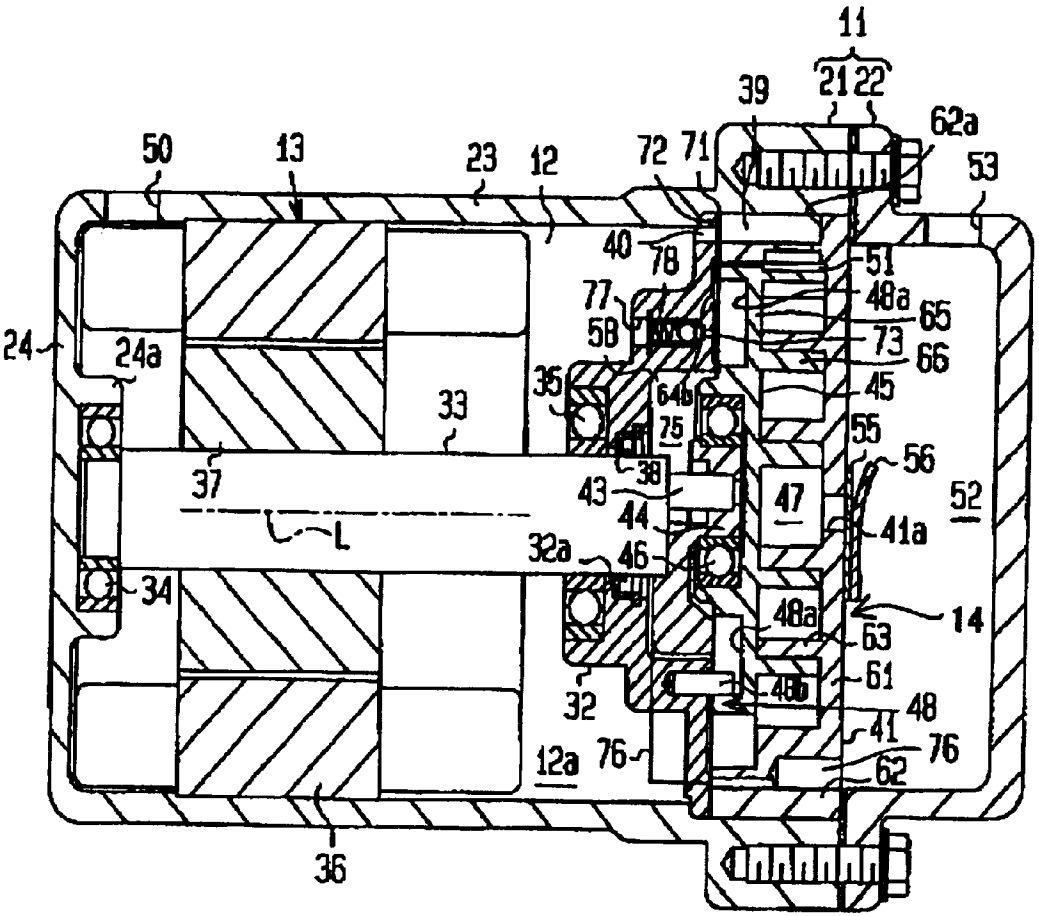
FIG. 1 is a longitudinal cross-sectional view of an electric compressor according to a preferred embodiment.

As shown in FIG. 1, an electric compressor includes a housing 11 having first and second housing member units 21 and 22. The first housing member unit 21 is fixedly joined to the second housing member unit 22. The first housing member unit 21 includes a cylindrical portion 23 having a bottom portion 24 at the left side of FIG. 1 and substantiality forms a cylinder with a bottom in shape. The first housing member 21 is formed by die casting of aluminum alloy. The second housing member unit 22 substantially forms a cylinder with a cover in shape and is formed by die casting of aluminum alloy. A closed chamber 12 is defined by the first and second housing member units 21 and 22 in the housing 11.

In the first housing member unit 21, a shaft support portion 24*a* is integrally formed on the central part of the inner wall surface of the bottom portion 24 so as to protrude therefrom. In the first housing member unit 21, a shaft support member 32 is fixed on the side of the opening end of the cylindrical portion 23. A hole 32*a* is formed in the central part of the shaft support member 32 so as to extend therethrough. A rotary shaft 33 is accommodated in the first housing member unit 21. The rotary shaft 33 is rotatably supported by the shaft support portion 24*a* through a bearing 34 at the left end side of FIG. 1. The rotary shaft 33 is interposed through the hole 32*a* of the shaft support member 32 and is rotatably supported by the shaft support member 32 through a bearing 35 at the right end side of FIG. 1. A seal member 38 is arranged between the shaft support member 32 and the rotary shaft 33 for sealing the rotary shaft 33. Therefore, a motor chamber 12*a* is defined on the left side of the FIG. 1 by the cylindrical portion 23 and the shaft support member 32 in the closed chamber 12.

In the motor chamber 12*a* in the closed chamber 12, a stator 36 is mounted on the inner circumferential surface of the cylindrical portion 23 of the first housing member unit 21. In the motor chamber 12*a*, a rotor 37 is fixed to the rotary shaft 33 on the inner circumferential side of the stator 36. An electric motor 13 is constituted of the stator 36 and the rotor 37. The electric motor 13 rotates the rotor 37 integrally with the rotary shaft 33 by supplying power to the stator 36.

Figure 2B:
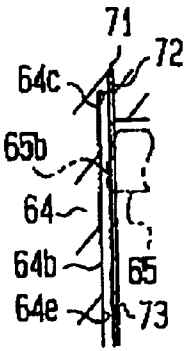
FIG. 2B is a partially enlarged longitudinal cross-sectional view of the electric compressor according to the preferred embodiment when it is assumed that a movable scroll member is removed from the electric compressor in FIG. 2A.
Figure 2A:
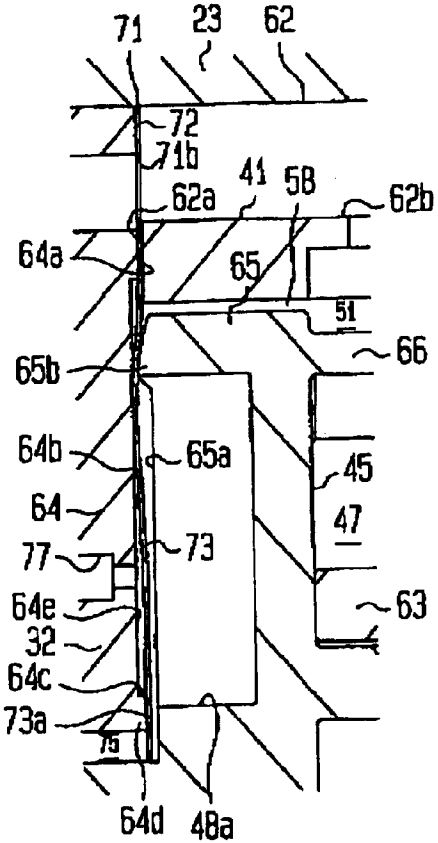
FIG. 2A is a partially enlarged longitudinal cross-sectional view of the electric compressor according to the preferred embodiment.

A fixed scroll member 41 is fixedly arranged in the first housing member unit 21 on the side of the opening end of the cylindrical portion 23. The fixed scroll member 41 includes a fixed base plate 61 that has a disc-shape, an outer circumferential wall 62 and a fixed spiral wall 63. The outer circumferential wall 62 extends from the outer circumferential side of the fixed base plate 61. The fixed spiral wall 63 extends from the fixed base plate 61 on the inner circumferential side of the outer circumferential wall 62. As shown in FIGS. 2A and 2B, an end surface 62*a* of the outer circumferential wall 62 is joined to a radially outer portion 84 of the shaft support member 32 having an annular shape. Therefore, in the closed chamber 12, a scroll chamber 58 is defined by the fixed base plate 61 of 6 the fixed scroll member 41, the outer circumferential wall 62 of the fixed scroll member 41, the shaft support member 32 and also sealing the rotary shaft 33 by the seal member 38. Namely, the shaft support member 32 and the fixed scroll member 41 respectively are outer hull members th constitute an outer hull of the scroll chamber 58.

A crankshaft 43 is formed at the end surface of the rotary shaft 33 on the side of the fixed scroll member 41 in the scroll chamber 58 and is offset from an axis L of the rotary shaft 33 in an eccentric direction. The crankshaft 43 is inserted in a bushing 44. A movable scroll member 45 is accommodated in the scroll chamber 58 and is supported by the bushing 44 through a bearing 46 so as to face the fixed scroll member 41 and so as to rotate relative to the rotary shaft 33. The movable scroll member 45 includes a movable base plate 66 that has a disc-shape and a movable spiral wall 66 that extends from the movable base plate 65 toward the fixed scroll member 41. As shown in FIG. 2A, an annular protrusion 65*b* is formed on the periphery of a back surface 65*a* of the movable base plate 65. The inner periphery of the protrusion 65*b* is slightly larger than the outer periphery of the protrusion 65*b*.

The movable spiral wall 66 of the movable scroll member 45 is engaged with the fixed spiral wall 63 of the fixed scroll member 41 in the scroll chamber 58. The end surfaces of the fixed and movable spiral wall 63 and 66 directly contact the movable and fixed base plates 85 and 61, respectively. Therefore, the fixed base plate 61 and the fixed spiral wall 63 of the feed scroll member 41 and the movable base plate 65 and the movable spiral wall 66 of the movable scroll member 45 define compression chambers 47 in the scroll chamber 58.

A self rotation preventing mechanism 48 is arranged between the movable base plate 66 of the movable scroll member 46 and the shaft support member 32. The self rotation preventing mechanism 48 is constituted of a plurality of annular holes 48*a* and a plurality of pins 48*b*. A plurality of annular holes 48*a* s formed on the radially outer part of the back surface 65*a* of the movable base plate 65. A plurality of pins 48*b* is mounted on the radially outer portion 64 of the shaft support member 32 and is loosely fitted in the corresponding annular hole 48*a*. Only one pin 48*b* is shown in FIG. 1.

In the scroll chamber 58, a suction chamber 51 is defined between the outer circumferential wall 62 of the fixed scroll member 41 and the outer circumferential portion of the movable spiral wall 66 of the movable scroll member 45. A recess 62*b* is formed on the outer circumferential surface of the outer circumferential wall 62 of the fixed scroll member 41. The outer circumferential wall 82 of the fixed scroll member 41 is joined to the inner circumferential surface of the opening side of the first housing member unit 21, and a suction passage 39 is formed by surrounding by the recess 62*b* and the inner circumferential surface of the first housing member unit 21. The suction passage 39 communicates with the suction chamber 51.

An inlet 50 is formed on the outer circumferential surface of the cylindrical portion 23 of the first housing member unit 21 corresponding to the motor chamber 12*a*. An external pipe, which is not shown and is connected to an evaporator of an external refrigerant circuit, is connected to the inlet 50. The inlet 50 communicates with the motor chamber 12*a*. A through hole 40 is formed in the radially outer portion 64 of the shaft support member 32 so as to extend therethrough. The motor chamber 12*a* is interconnected with the suction passage 39 through the through hole 40. Therefore, low-pressure refrigerant gas from the external refrigerant circuit is introduced into the suction chamber 51 through the inlet 50, the motor chamber 12*a*, the through hole 40 and the suction passage 39.

A discharge chamber 52 is defined by the second housing member unit 22 and the fixed scroll member 41 in the closed chamber 12. An outlet 53 is formed in the second housing member unit 22 and communicates with the discharge chamber 52. An external pipe, which is not shown and is connected to a condenser of the external refrigerant circuit, is connected to the outlet 53. Therefore, the high-pressure refrigerant gas in the discharge chamber 52 is discharged into the external refrigerant circuit through the outlet 53.

A discharge port 41*a* is formed at the center of the fixed scroll member 41. The compression chamber 47 near the center of the fixed scroll member 41 is interconnected with the discharge chamber 52 through the discharge port 41*a*. A discharge valve 55 is arranged on the fixed scroll member 41 in the discharge chamber 52 and is constituted of a reed valve for opening and closing the discharge port 41*a*. A retainer 56 is fixedly arranged on the fixed scroll member 41 in the discharge chamber 52. The opening degree of the discharge valve 55 is restricted by the retainer 56.

When the rotary shaft 33 is rotatively driven by the electric motor 13, the movable scroll member 45 orbits around th axis of the fixed scroll member 41 (the axis L of the rotary shaft 33) through the crankshaft 43 in a compression mechanism 14. At this time, the self rotation preventing mechanism 48 prevents the movable scroll member 45 from self-rotating white allowing the movable scroll member 45 to orbit around the axis of the fixed scroll member 41. The compression chamber 47 is gradually reduced in volume as refrigerant gas in the compression chamber 47 is gradually compressed and is moved toward the center side of the fixed and movable spiral walls 63 and 68 by orbital movement of the movable scroll member 45 relative to the fixed scroll member 41. Therefore, the low-pressure refrigerant gas introduced from the suction chamber 51 into the compression chamber 47 is compressed. After compression, the high-pressure refrigerant gas is discharged from the discharge port 41*a* into the discharge chamber 52 through the discharge valve 55.

Figure 5:
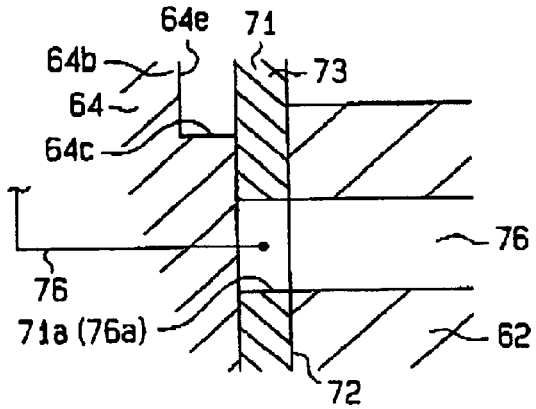
FIG. 5 is a partially enlarged longitudinal cross-sectional view of the electric compressor around an oblong through hole of th elastic member according to the preferred embodiment.

As shown in FIGS. 1, 2A and 5, a back pressure chamber 75 is defined in the scroll chamber 58 on the side of the back surface 65*a* of the movable base plate 65 of the movable scroll member 45. A pressure supply passage 76 having a throttle 76*a* is forked on the outer circumferential side of the fixed scroll member 41 in the closed chamber 12. The back pressure chamber 75 is interconnected with the discharge chamber 52 as a discharge pressure region through the pressure supply passage 76. Therefore, the high-pressure refrigerant gas is supplied from the discharge chamber 52 to the back pressure chamber 75, 16 and the movable scroll member 45 is urged toward the fixed scroll member 41 by urging force resulting from the high-pressure refrigerant gas in the back pressure chamber 75.

A bleed page 77 is formed in the shaft support member 32. The back pressure chamber 75 is interconnected wit the motor chamber 12*a* (a suction pressure region) in the closed chamber 12 through the bleed passage 77. A control valve 78 is arranged on the bleed passage 77 and adjusts the opening degree of the bled passage 77 in accordance with the differential pressure between the back pressure chamber 75 and the motor chamber 12*a*. The control valve 78 opens and closes so as to keep the constant differential pressure between the back pressure chamber 75 and the motor chamber 12*a*. Therefore, when the electric compressor is in a normal operation state, the urging force resulting from the pressure in the back pressure chamber 75 that is applied to the movable scroll member 45 is kept constant by the opening and closing of the control valve 78.

Figure 4:
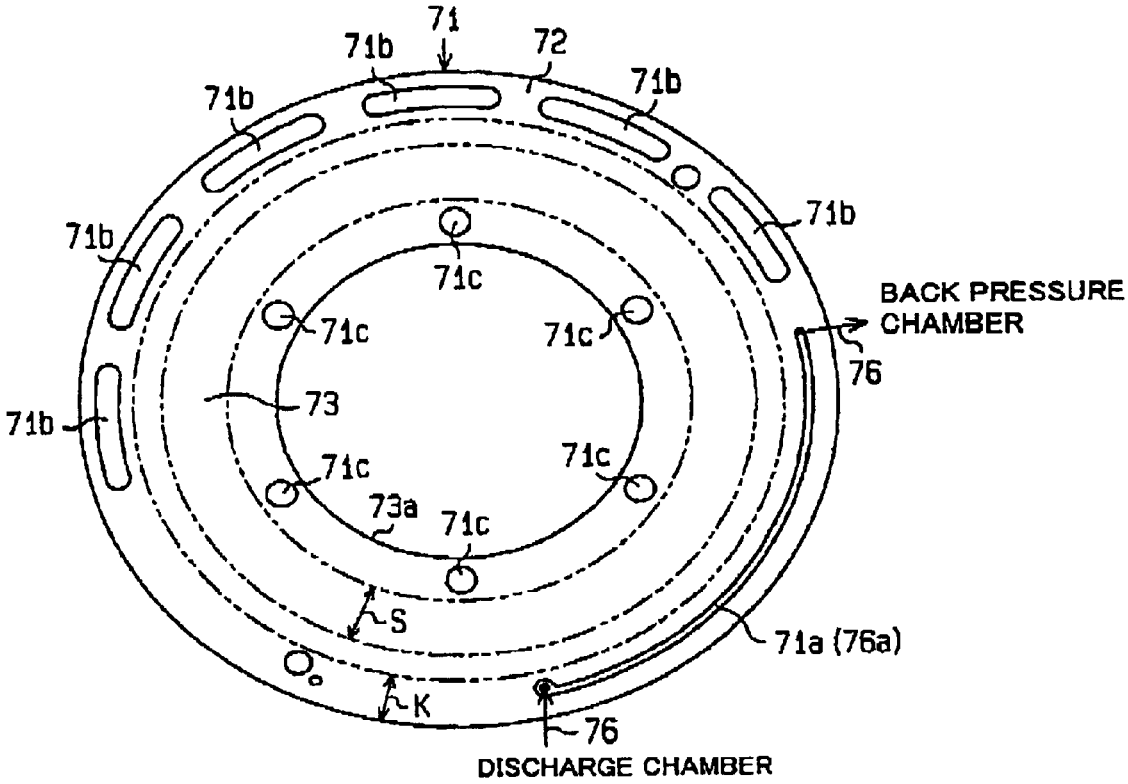
FIG. 4 is a front view of an elastic member according to the preferred embodiment.

As shown in FIGS. 1, 2A and 4, an elastic member 71 that is formed in an annular and planar shape is arranged on the side of the back surface 65*a* of the movable base plate 65 of the movable scroll member 45 in the scroll chamber 568. Metallic material such as SK material is utilized for the material of the elastic member 71. A radially outer portion 72 of the elastic member 71 is sandwiched at a joining part between the shaft support member 32 and the fixed scroll member 41, which are adjacent to each other, in a first annular contact region (an sandwiched region K shown in FIG.4). Therefore, the elastic member 71 is fixed in the housing 11. The joining part between the shaft support member 32 and the fixed scroll member 41, more particularly, the joining part between an outer peripheral portion 64*a* of the radially outer portion 64 of the shaft support member 32 and the end surface 62*a* of the outer circumferential wall 62 of the fixed scroll member 41, is sealed by sandwiching the radially outer portion 72 of the elastic member 71 therebetween. Namely, the radially outer portion 72 of th elastic member 71 serves to seal the joining part between the shaft support member 32 and the fixed scroll member 41.

As shown in FIGS. 4 and 5, an oblong through hole 71*a* is formed in the radially outer portion 72 of the elastic member 71 so as to extend therethrough. The oblong through hole 71*a*, the outer peripheral portion 64*a* of the radially outer portion 64 of the shaft support member 32 and the end surface 62*a* of the outer circumferential wall 82 of the fixed scroll member 41 define a second space that constitutes a part of the pressure supply passage 76 (more particularly the throttle 76*a*) interconnecting the discharge chamber 52 with the back pressure chamber 75. A plurality of through holes 71*b* is formed in the radially outer portion 72 of the elastic member 71 so as to extend therethrough and interconnect the recess 62*b* (the suction page 39) with the through hole 40 of the shaft support member 32. Also, a plurality of holes 71*c* is formed in a radially inner portion 73 of the elastic member 71 so as to extend therethrough. Each of the pins 48*b* of the self rotation preventing mechanism 48 is interposed through the associated hole 71*c*.

As shown in FIGS. 1 and 2A, the radially outer portion 64 of the shaft support member 32 includes a facing wall 64*b* which is in a second annular region and is an inner circumferential side with respect to the outer peripheral portion 64*a* of the radially outer portion 64 of the shaft support member 32, which is joined to the fixed scroll member 41. The facing wall 64*b* faces the radially inner portion 73 of the elastic member 71 on a side opposite to the side of the movable scroll member 45. An annular recess 64*c* is formed in the facing wall 64*b* so as to have a same axis to the axis L of the rotary shaft 33. Therefore, a support portion 64*d* that forms an annular protrusion in shape is formed in the facing wall 64*b* at a position facing an inner peripheral portion 73*a* of the elastic member 71 so as to have a same axis to the axis L of the rotary shaft 33. The end surface of the support portion 64*d* and the outer peripheral portion 64*a* of the shaft support member 32 are included in the same plane. Therefore, the elastic member 71 is not only held by sandwiching the radially outer portion 72 of the elastic member 71 between the shaft support member 32 and the fixed scroll member 41, but also supported by contacting the inner peripheral portion 73*a* of the elastic member 71 with the support portion 64*d*.

As shown in FIG. 2B, due to the formation of the recess 64*c*, a first space (an allowance space) is formed between the radially inner portion 73 of the elastic member 71 in the natural state and the facing wall 64*b* of the shaft support member 32 for allowing the elastic member 71 to be elastically deformed. As shown by a two-dot chain line in FIG. 2B, the dimensions of the fixed and movable scroll members 41 and 45 are designed such that the top end of the protrusion 65*b* of the movable scroll member 45 protrudes toward the side of the shaft support member 32 with respect to the end surface 62*a* of the outer circumferential wall 62 of the fixed scroll member 41 in a state that the electric compressor is assembled. Therefore, as shown in FIG. 2A, in the state that the electric compressor is assembled, the protrusion 65*b* of the movable scroll member 45 press-contacts the radially inner portion 73 of the elastic member 71 in the second annular contact region, and the radially inner portion 73 is elastically deformed toward the facing wall 64*b* of the shaft support member 32.

In the elastic member 71, the inner peripheral portion 73*a* of the radially inner portion 73 is supported by contacting the support portion 64*d* of the shaft support member 32 in the second annular contact region. Therefore, the elastic member 71 is elastically deformed as the inner peripheral portion 73*a* press-contacts the support portion 64*d*, and the middle of the radially inner portion 73 is stretched toward the recess 64*c*. The maximum amount of the elastic deformation of the radially inner portion 73 of the elastic member 71 is restricted by contacting a bottom surface 64*e* of the recess 64*c*. Namely, the bottom surface 64*e* of the recess 64*c* is a restrictive portion.

The radially inner portion 73 of the elastic member 71 is elastically deformed by the press-contact of the movable scroll member 45. The movable scroll member 45 is urged toward the fixed scroll member 41 by urging force resulting from the elastic deformation of the radially inner portion 73 of the elastic member 71. Therefore, the end surfaces of the fixed spiral wall 63 of the fixed scroll member 41 and the movable spiral wall 66 of the movable scroll member 45 respectively contact the movable base plate 65 of the movable scroll member 45 and the fixed base plate 61 of the fixed scroll member 41 by the urging force resulting from the elastic deformation of the elastic member 71 and the pressure in the back pressure chamber 75. Accordingly the sealing of the compression chambers 47 is ensured.

Figure 3:
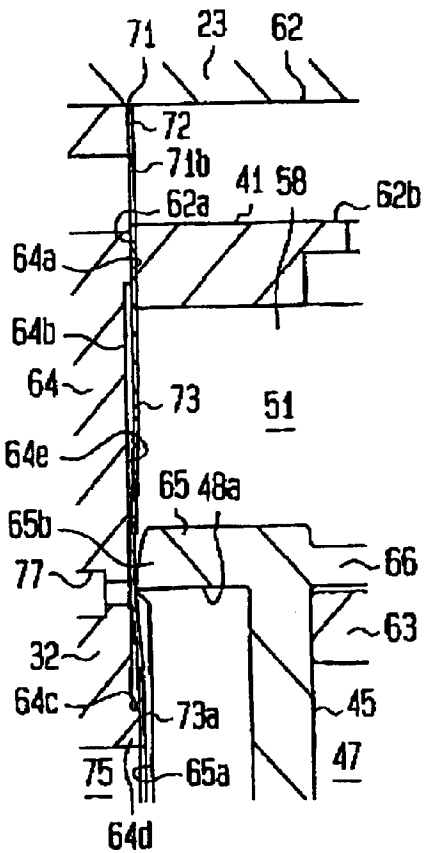
FIG. 3 is a partially enlarged longitudinal cross-sectional view of the electric compressor according to the preferred embodiment when an orbital position of the movable scroll member is different from that in FIG. 2A.

As shown in FIGS. 2 and 3, the press-contact of the elastic member 71 with the movable scroll member 45 in the second annular contact region is maintained at any orbital position of the movable scroll member 45 relative to the fixed scroll member 41 (the elastic member 71). Namely, a sliding region S (shown in FIG. 4) of the elastic member 71 relative to the movable scroll member 46 (the protrusion 66*b*) is provided so as to be continuously and slidably press-contacted by the movable scroll member 45 in the second annular contact region. Therefore, the back pressure chamber 75 is sealed separately from the other region of the scroll chamber 8 (the suction chamber 51) at a press-contact part between the movable scroll member 45 and the radially inner portion 73 of the elastic member 71 in the second annular contact region.

According to the abovementioned preferred embodiment, the following advantageous effects are obtained.

(1) It is easy to manufacture the planar elastic member 71. Also, it is easy to control the thickness of the elastic member 71, which largely affects the setting of the urging force (spring force) that urges the movable scroll member 45 toward the fixed scroll member 41. Therefore, the elastic member 71 can be manufactured at a relatively low cost. In other words, the allowance space (the recess 64*c*) is formed between the elastic member 71 and the facing wall 64*b*, which is prodded on the side opposite to the side of the movable scroll member 45 with respect to the elastic member 71. Therefore, even though the elastic member 71 is planar, or even though the shape of the cross section of the elastic member 71 is not formed so as to function as a spring as disclosed in Japanese Unexamined Patent Publication No. 8-219053, the elastic member 71 functions as a spring.

Furthermore, compared to the technique disclosed in Japanese Unexamined Patent Publication No. 8-219053, the amount of the deformation (spring stroke length) of the elastic member 71 (the radially inner portion 73) can be easily set to a relatively large value. Therefore, for example, even through the dimensional tolerances of the fixed scroll member 41 and the movable scroll member 45 in the direction of the axis L of the rotary shaft 33 are relatively large, the dimensional tolerances are absorbed by the elastic deformation of the elastic member 71. As a result, work for adjusting the clearance between the fixed and movable scroll members 41 and 45 in the direction of the axial L of the rotary shaft 33 can be cut.

(2) The amount of the elastic deformation of the elastic member 71 is restricted by contacting the elastic member 71 with the bottom surface 64*e* of the recess 64*c* of the shaft support member 32. Therefore, for example, even though the compression reactive force, which is applied to the movable scroll member 45 in the direction of the axial L of the rotary shaft 33, becomes excessive due to the compression of liquid, the elastic member 71 is not excessively deformed due to contacting the elastic member 71 with the bottom surface 64*e*. As a result, the plastic deformation and the breaking of the elastic member 71 caused by the excessive elastic deformation of the elastic member 71 can be avoided.

(3) in the facing wall 64*b* of the shaft support member 32, the support portion 64*d* is formed at the position facing the inner peripheral portion 73*a* of the elastic member 71 and supports the inner peripheral portion 73*a* of the elastic member 71 by contacting the inner peripheral portion 73*a* of the elastic member 71. Namely, while the elastic member 71 is fixed in the housing 11 at its radially outer portion 72, the inner peripheral portion 73*a* of the elastic member 71 is supported by contacting the support portion 64*d*. The elastic member 71 functions as a leaf spring whose ends are hold. Therefore, the elastic deformation of the elastic member 71 is stable. For example, the contact of the elastic member 71 with the movable scroll member 45 in the second annular contact region, or the sealing of the back pressure chamber 75 can be maintained at any orbital position of the movable scroll member 45 with respect to the elastic member 71.

(4) The movable scroll member 45 is urged toward the fixed scroll member 41 by th high-pressure refrigerant gas supplied to the back pressure chamber 75. Namely, the movable scroll member 45 is urged toward the fixed scroll member 41 not only by the urging force resulting from the elastic deformation of the elastic member 71 but also by the urging force resulting from the pressure in the back pressure chamber 75. Therefore, for example, when the electric compressor is in the normal operation state, the urging forces can cope with the compression reactive force applied to the movable scroll member 45 in the direction of the axial L of the rotary shaft 33. The sealing of the compression chamber 47 can be maintained without arranging seal member (e.g. tip seals) at the end surfaces of the fixed and movable spiral member 63 and 66 as mentioned in the present preferred embodiment (5) The elastic member 71 is press-contacted by the movable scroll member 45 in the second annular contact region, and the back pressure chamber 75 is sealed at the press-contact part. Therefore, the seal structure for the back pressure chamber 75 can be simplified.

(6) The elastic member 71 is fixed in the housing 11 in such a manner that the radially outer portion 72 of the elastic member 71 is sandwiched at the joining part between the shaft support member 32 and the fixed scroll member 41. Therefore, when the shaft support member 32 is joined to the fixed scroll member 41, the elastic member 71 can be fixed in the housing 11. As a result, an additional structure for fixing the elastic member 71 in the housing 11 is unnecessary, and the structure for fixing the elastic member 71 in the housing 11 can be simplified.

(7) The radially outer portion 72 of the elastic member 71 is sandwiched at the joining part between the shaft support member 32 and the fixed scroll member 41 in the first annular contact region, thereby the elastic member 71 serves as a seal member for the joining part. Accordingly, an additional seal member for sealing the pining part between the shaft support member 32 and the fixed scroll member 41, that is, for sealing the scroll chamber 58 is unnecessary, and the seal structure for the scroll chamber 58 can be simplified.

(8) The second space defined by the oblong through hole 71*a* which is formed in the radially outer portion 72 of the elastic member 71, the outer peripheral portion 64*a* of the shaft support member 32 and the end surface 62*a* of the outer circumferential wall 62 of the fixed scroll member 41 is utilized as a part of a passage for the refrigerant gas. Namely, the oblong through hole 71*a* is formed by being sandwiched between the outer peripheral portion 64*a* and the end surface 62*a*. The above way is possible to form a passage having a small cross-sectional area with high accuracy more easily than the other ways, for example, the way in which a small hole is formed with a drill. Namely, such a way of forming a passage is especially advantageous to the case that the throttle 78*a* of the pressure supply passage 76 is formed as mentioned in the present preferred embodiment.

According to the present invention, the following alternative preferred embodiments may be practiced.

Figure 6:
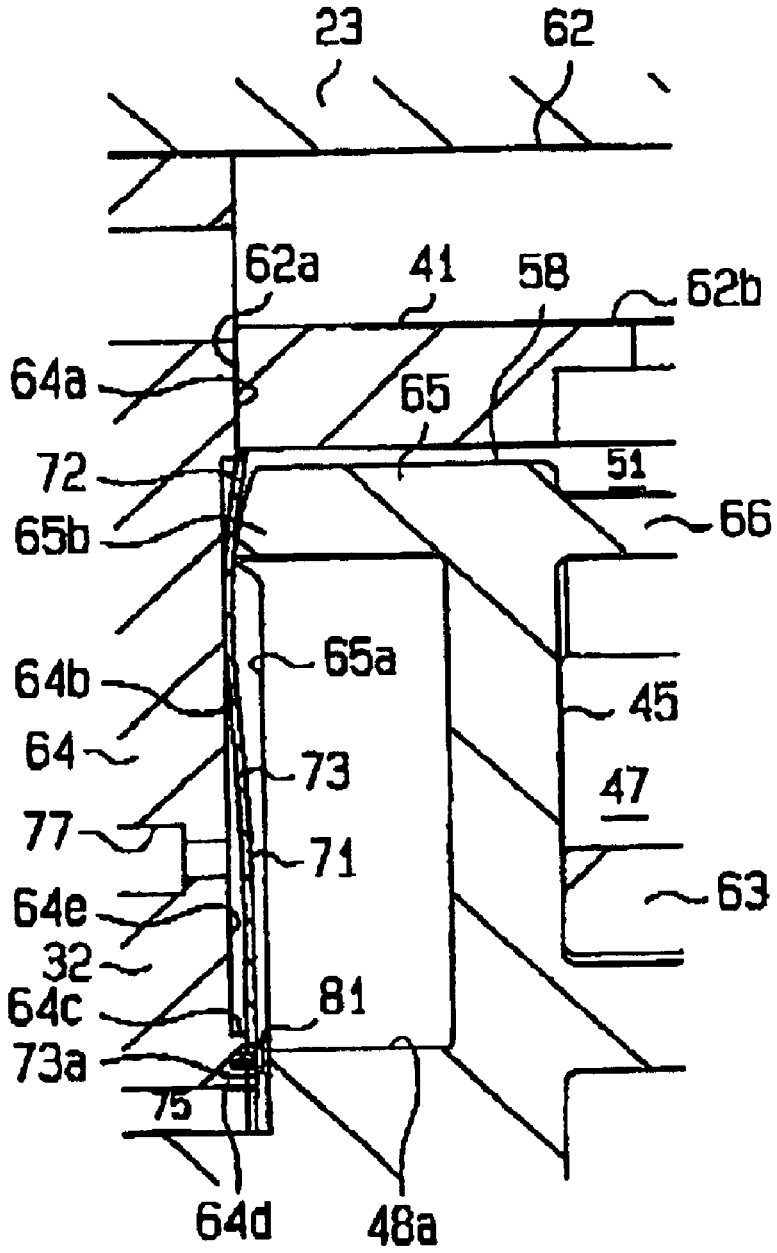
FIG. 6 is a partially enlarged longitudinal cross-sectional view of an electric compressor according to a first alternative preferred embodiment

In the abovementioned preferred embodiment, the radially outer portion 72 of the elastic member 71 is fixed in the housing 11. In a first alternative preferred embodiment, the elastic member 71 may be fixed in the housing 11 at the radially inner portion 73. Namely, for example, as shown in FIG. 8, an elastic member 71 having a reduced diameter is utilized so as to accommodate in the scroll chamber 58. The elastic member 71 is in the housing 11 by bolting the radially inner portion 73 to the end surface of the support portion 64*d* with a bolt 81. In the first alternative preferred embodiment as shown in FIG. 6, in the elastic member 71, not only the radially inner portion 73 but also the radially outer portion 72 placed in the scroll chamber 58 are elastically deformed toward the side of the facing wall 64*b*.

In the abovementioned preferred embodiment, the elastic member 71 is fixed in the housing 11 in such a manner that the radially outer portion 72 of the elastic member 71 is sandwiched at the joining part between the shaft support member 32 and the fixed scroll member 41. In a second alternative preferred embodiment, the elastic member 71 may be fixed in the housing 11 by bolting the radially outer portion 72 of the elastic member 71.

In a third alternative preferred embodiment, the support portion 64*d* may be removed from the shaft support member 32. In this case, the elastic member 71 is fixed in the housing 11 only at the radially outer portion 72 and functions as a leaf spring whose end is held.

In the above-mentioned preferred embodiment the second space defined by the oblong through hole 71*a* which is formed in the elastic member 71, the outer peripheral portion 64*a* of the shaft support member 32 and the end surface 62*a* of the outer circumferential wall 62 of the fixed scroll member 41 is utilized as a part of the pressure supply passage 78 interconnecting the discharge chamber 52 with the back pressure chamber 75. However, such a way of forming a gas passage is not limited to utilize to form a passage for introducing gas into the back pressure chamber 75. In a fourth preferred embodiment, such a way may be utilized to form other gas passages such as a passage for bleeding gas from the back pressure chamber 75 (the bleed passage 77) and a gas passage in a refrigerating cycle.

In the abovementioned preferred embodiment, the present invention is applied to the electric scroll type compressor. However, the present invention is not limited to apply to the electric scroll type compressor. In a fifth alternative preferred embodiment, the present invention may be applied to a scroll type compressor driven by an engine of a vehicle and a scroll type compressor selectively driven by an electric motor and a engine of a vehicle.

The present examples and embodiments are to be considered as illustrative and not restrictive, and the invention is not to be limited to the details given herein but may be modified within the scope of the appended claims.

What is claimed is:

1. A scroll type compressor comprising:

a housing;

a fixed scroll member fixed in the housing, the fixed scroll member having a fixed base plate and a fixed spiral wall that extends from the fixed base plate;

a movable scroll member placed in the housing, the movable scroll member having a movable base plate and a movable spiral wall that extends from the movable base plate, the movable spiral wall being engaged with the fixed spiral wall, a compression chamber being defined between the movable spiral wall and the fixed spiral wall, the compression chamber being gradually reduced in volume as refrigerant in the compression chamber is gradually compressed and is moved toward a center side of the spiral walls by orbital movement of the movable scroll member relative to the fixed scroll member;

an elastic member formed in an annular and planar shape, the elastic member being fixed in the housing on a side of a back surface of the movable base plate so as to slidably contact the back surface of the movable base plate at a sliding region of the elastic member; and a facing wall provided on a side opposite to a side of the movable scroll member with respect to the elastic member, wherein a first space is formed between the elastic member and the facing wall for allowing the elastic member to be elastically deformed, the elastic member being elastically deformed toward the facing wall by press-contacting the movable scroll member, whereby the movable scroll member is urged toward the fixed scroll member.

2. The scroll type compressor according to claim 1, wherein the facing wall includes a restrictive portion for restricting the amount of the elastic deformation of the elastic member by contacting the elastic member.

3. The scroll type compressor according to claim 1, wherein the whole of the elastic member is formed in a planar shape.

4. The scroll type compressor according to claim 1, wherein a back pressure chamber is defined in the housing on the side of the back surface of the movable base plate, the movable scroll member being urged toward the fixed scroll member by urging force resulting from pressure in the back pressure chamber.

5. The scroll type compressor according to claim 4, wherein the sliding region of the elastic member is press-contacted by the movable scroll member in a second annular contact region, the back pressure chamber being sealed at a press-contact part between the elastic member and the movable scroll member.

6. The scroll type compressor according to claim 1, wherein the elastic member is fixed at a radially outer portion of the elastic member.

7. The scroll type compressor according to claim 6, wherein the facing wall includes a support portion at a position facing an inner peripheral portion of the elastic member for supporting the inner peripheral portion of the elastic member by contacting the inner peripheral portion of the elastic member.

8. The scroll type compressor according to claim 6, wherein the movable scroll member is accommodated in a scroll chamber that is defined in the housing by an outer hull of the scroll chamber, wherein the outer hull includes a plurality of outer hull members joined to each other, wherein the elastic member is fixed in the housing in such a manner that the radially outer portion of the elastic member is sandwiched at a joining part between the adjacent outer hull members.

9. The scroll type compressor according to claim 8, wherein the radially outer portion of the elastic member serves to seal the joining part between the adjacent outer hull members in such a manner that the radially outer portion is sandwiched at the joining part in a first annular contact region.

10. The scroll type compressor according to claim 8, wherein an oblong through hole is formed in the radially outer portion of the elastic member so as to extend through the radially outer portion of the elastic member, the oblong through hole and the adjacent outer hull members defining a second space that is utilized as a passage for gas.

11. The scroll type compressor according to claim 10, wherein a back pressure chamber is defined in the scroll chamber on the side of the back surface of the movable base plate, wherein a discharge pressure region is defined in the housing, wherein a pressure supply passage is formed in the housing and interconnecting the back pressure chamber with the discharge pressure region, the second space being utilized as a part of the pressure supply passage.

12. The scroll type compressor according to claim 1, wherein the elastic member is fixed at a radially inner portion of the elastic member.

13. The scroll type compressor according to claim 12, wherein the elastic member is fixed in the housing by bolting the radially inner portion of the elastic member to the facing wall with a bolt.

* * * * *

UNITED STATES PATENT AND TRADEMARK OFFICE

CERTIFICATE OF CORRECTION

PATENT NO. : 6,872,063 B2
DATED : March 29, 2005
INVENTOR(S) : Kimura et al.

It is certified that error appears in the above-identified patent and that said Letters Patent is hereby corrected as shown below:

Column 1,
Line 30, delete “8-219063” and insert therefor -- 8-219053 --.

Column 2,
Line 9, delete “18” and insert therefor -- is --.

Column 4,
Line 18, delete “66” and insert therefor -- 65 --.
Line 19, delete “46” and insert therefor -- 45 --.
Line 35, delete “82” and insert therefor -- 62 --.

Column 5,
Line 19, delete “68” and insert therefor -- 66 --.
Line 59, delete “568” and insert therefor -- 58 --.

Column 6,
Line 16, delete “82” and insert therefor -- 62 --.

Column 7,
Line 37, delete “66*b*” and insert therefor -- 65*b* --.
Line 42, delete “8” and insert therefor -- 58 --.

Column 9,
Lines 28 and 43, delete “abovementioned” and insert therefor -- above-mentioned --.
Line 34, delete “8” and insert -- 6 --.
Line 62, delete “78” and insert therefor -- 76 --.

Signed and Sealed this

Twenty-seventh Day of September, 2005

JON W. DUDAS
*Director of the United States Patent and Trademark Office*